US009890687B2

(12) United States Patent
Kim

(10) Patent No.: US 9,890,687 B2
(45) Date of Patent: Feb. 13, 2018

(54) ENGINE SYSTEM HAVING TWO COOLING LOOPS

(71) Applicant: Hyundai Motor Company, Seoul (KR)

(72) Inventor: Won Sup Kim, Incheon (KR)

(73) Assignee: Hyundai Motor Company, Seoul (KR)

( * ) Notice: Subject to any disclaimer, the term of this patent is extended or adjusted under 35 U.S.C. 154(b) by 252 days.

(21) Appl. No.: 14/859,071

(22) Filed: Sep. 18, 2015

(65) Prior Publication Data

US 2016/0201549 A1 Jul. 14, 2016

(30) Foreign Application Priority Data

Jan. 8, 2015 (KR) ..... 10-2015-0002683

(51) Int. Cl.
*F01P 7/14* (2006.01)
*F01P 7/16* (2006.01)

(52) U.S. Cl.
CPC ..... *F01P 7/165* (2013.01); *F01P 2007/146* (2013.01); *F01P 2060/02* (2013.01); *F01P 2060/12* (2013.01)

(58) Field of Classification Search
CPC .... F01P 7/165; F01P 2060/12; F01P 2060/02; F01P 2007/146
See application file for complete search history.

(56) References Cited

U.S. PATENT DOCUMENTS

2011/0023796 A1* 2/2011 Cattani ..... F01P 3/12 123/41.1
2012/0297765 A1* 11/2012 Vigild ..... F01P 3/20 60/599

FOREIGN PATENT DOCUMENTS

| | | | |
|---|---|---|---|
| JP | 2007-38874 | A | 2/2007 |
| JP | 2013-104314 | A | 5/2013 |
| JP | 2014-15885 | A | 1/2014 |
| JP | 2014-156804 | A | 8/2014 |
| KR | 10-2012-0059928 | A | 6/2012 |

* cited by examiner

*Primary Examiner* — Hung Q Nguyen
(74) *Attorney, Agent, or Firm* — Morgan, Lewis & Bockius LLP

(57) ABSTRACT

An engine system having two cooling loops may include a first coolant loop in which a first coolant circulates through an engine and a first radiator, a second coolant loop in which a second coolant circulates through a water-cooled inter-cooler and a second radiator, a first branch line that branches from one side of the first coolant loop, a second branch line that branches from one side of the second coolant loop, a mixture line allowing the first coolant and the second coolant to be mixed to flow therein, and branching to the first coolant loop and the second coolant loop, a temperature adjusting valve configured to control a temperature of the mixture coolant flowing in the mixture line, and a mixture coolant line allowing the mixture coolant to flow, and branching to the first coolant loop and the second coolant loop.

10 Claims, 4 Drawing Sheets

ENGINE SYSTEM HAVING TWO COOLING LOOPS

CROSS-REFERENCE TO RELATED APPLICATION

The present application claims priority to Korean Patent Application No. 10-2015-0002683 filed Jan. 8, 2015, the entire contents of which is incorporated herein for all purposes by this reference.

BACKGROUND OF THE INVENTION

Field of the Invention

The present invention relates to an engine system having two cooling loops including a first coolant loop circulating through an engine and a radiator and a second coolant loop circulating through a low temperature radiator and an exhaust gas recirculation (EGR) cooler.

Description of Related Art

Most diesel engines and some gasoline engines installed in vehicles include an EGR system to cope with exhaust gas regulations.

The EGR system resupplies a portion of an exhaust gas, which is discharged from an engine, through an intake manifold connected to the engine, thus decreasing a combustion temperature of the engine and reducing a generation amount of a nitrogen oxide (NOx).

Here, however, the exhaust gas has a high temperature and high pressure, and thus, when it is resupplied in the high temperature state, without being cooled, to the engine, the effect of reducing the generation amount of the nitrogen oxide (NOx), the original purpose of the EGR system, may be insufficient.

That is, the EGR system reduces a temperature of the exhaust gas through a heat exchanger in which a coolant circulates, and resupplies the exhaust gas having a reduced temperature to the engine through the intake manifold, thus reducing a generation amount of the nitrogen oxide.

An engine coolant circulating in the engine reaches about 90° C. and the recirculating exhaust gas reaches about 600° C., and thus, there is a limitation in stably cooling the recirculating exhaust gas using the engine coolant.

In order to overcome such a limitation, the recirculating exhaust gas may be cooled using a low temperature coolant (about 45° C.) for a water-cooled intercooler. In this case, however, the EGR cooler may be excessively cooled by the low temperature coolant so as to be damaged.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an engine system having two cooling loops having advantages of stably cooling a recirculating exhaust gas and preventing damage to an exhaust gas recirculation (EGR) cooler installed to cool the recirculating exhaust gas.

According to various aspects of the present invention, an engine system having two cooling loops may include a first coolant loop in which a first coolant circulates through an engine and a first radiator, a second coolant loop in which a second coolant circulates through a water-cooled intercooler and a second radiator, a first branch line that branches from one side of the first coolant loop, a second branch line that branches from one side of the second coolant loop, a mixture line formed as the first branch line and the second branch line join, allowing the first coolant and the second coolant to be mixed to flow therein, and branching to the first coolant loop and the second coolant loop, a temperature adjusting valve configured to control flows of the first and second coolants flowing in the first branch line and the second branch line to control a temperature of the mixture coolant flowing in the mixture line, and a mixture coolant line allowing the mixture coolant of the first coolant and the second coolant mixed through the temperature adjusting valve to flow, and branching to the first coolant loop and the second coolant loop.

The engine may include a first coolant pump disposed to pump the first coolant, a cylinder block in which a piston is configured to be disposed in a cylinder, a cylinder head disposed above the cylinder block, a turbo charger disposed to compress intake air, an oil cooler disposed to cool oil, a heater core disposed to heat indoor air, and a thermostat disposed to control a flow path and a flow rate of a coolant.

A second coolant pump pumping the second coolant may be disposed in the second coolant loop.

An exhaust gas recirculation (EGR) cooler cooling an exhaust gas recirculating from an exhaust line to an intake line by using the mixture coolant may be disposed in the mixture coolant line.

A coolant distribution tank in which a portion of the mixture coolant gathers may be disposed on a lower stream side of the EGR cooler.

The mixture coolant may be distributed from the coolant distribution tank to the first coolant loop and the second coolant loop.

An inlet through which the mixture coolant is supplied from the temperature adjusting valve may be formed in the coolant distribution tank, first and second outlets respectively connected to the first coolant loop and the second coolant loop may be formed on a first side and on a second side with respect to the inlet, and a partition hindering the mixture coolant from flowing from the inlet to the first outlet may be formed.

The engine system may further include a temperature sensing device configured to sense a temperature of the mixture coolant, and an electronic control unit (ECU) configured to control the temperature adjusting valve according to the temperature of the mixture coolant sensed by the temperature sensing device.

The temperature adjusting valve may include a 3-way valve and may control a flow of the first coolant flowing in the first branch line and a flow of the second coolant flowing in the second branch line.

The first radiator may outwardly dissipate heat of the first coolant circulating through the engine, the second radiator may outwardly dissipate heat of the second coolant circulating through the water-cooled intercooler, and the water-cooled intercooler may cool compressed air supplied to a combustion chamber of the engine.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
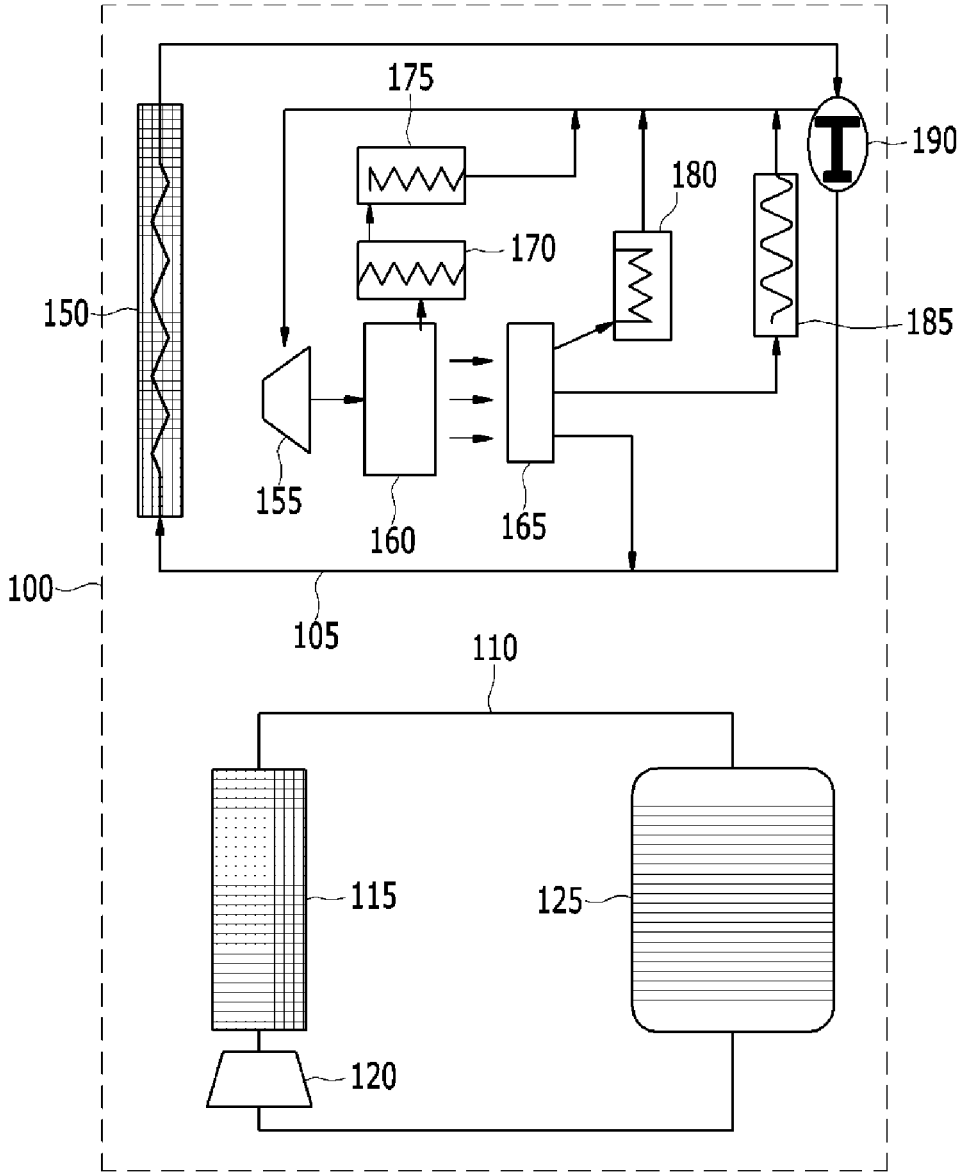
FIG. 1 is a schematic view illustrating a configuration of an engine system having two cooling loops related to the present invention.

FIG. 1 is a schematic view illustrating a configuration of an engine system having two cooling loops related to the present invention.

Referring to FIG. 1, an engine system 100 includes a first coolant loop 105 and a second coolant loop 110. In the first coolant loop 105, a first coolant pump 155, a cylinder block 160, a cylinder head 165, an EGR cooler 170, an oil cooler 175, a turbo charger 180, a heater core 185, a thermostat 190, and a first radiator 150 are disposed.

In the second coolant loop 110, a second radiator 115, a second coolant pump 120, and a water-cooled intercooler 125 are disposed.

A first coolant pumped by the first coolant pump 155 circulates through the cylinder block 160, the EGR cooler 170, and the oil cooler 175, and also circulates through the cylinder head 165, the turbo charger 180, and the heater core 185.

The first radiator 150 serves to outwardly dissipate heat of the first coolant, and the first coolant pump 155 serves to pump a coolant. A cylinder in which a piston is disposed is formed in the cylinder block 160, and the cylinder head 165 is disposed above the cylinder block 160 to form a combustion chamber together with the cylinder block 160.

The EGR cooler 170 serves to cool a recirculating exhaust gas recirculating from an exhaust line to an intake line, and the oil cooler 175 serves to control a temperature of oil circulating through the cylinder block 160, the cylinder head 165, or a transmission.

The turbo charger 180 may serve to compress intake air flowing along an intake line and supply the compressed air to the combustion chamber, the heater core 185 may serve to heat indoor air, and the thermostat 190 may be controlled according to a temperature of a coolant to control a coolant circulating through the first radiator 150.

The second coolant pump 120 pumps a second coolant circulating through the second radiator 115 and the water-cooled intercooler 125, the second radiator 115 outwardly dissipate heat of the second coolant, and the water-cooled intercooler 125 serves to control a temperature of intake air compressed by the turbo charger 180.

Figure 2:
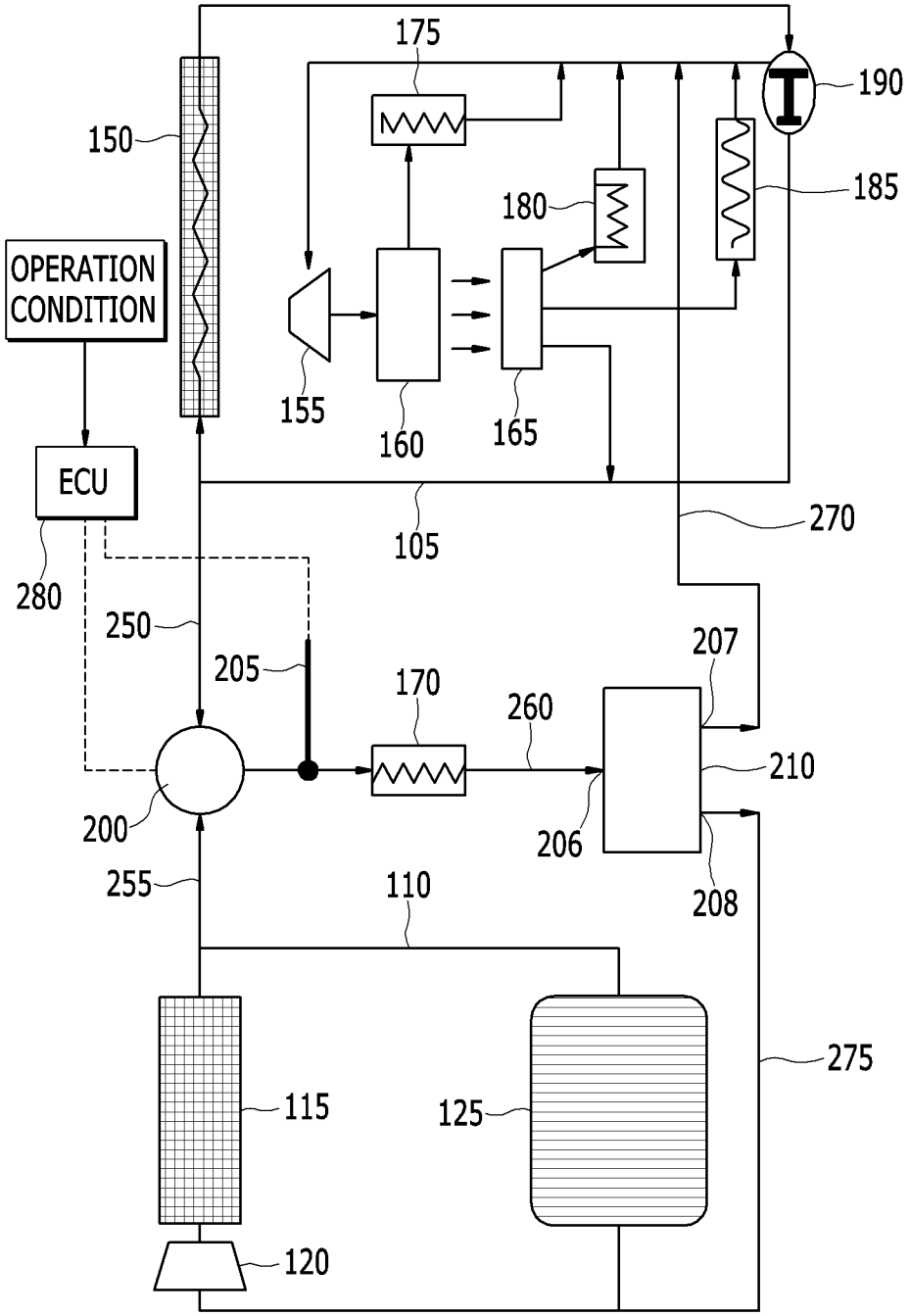
FIG. 2 is a schematic view illustrating a configuration of an exemplary engine system having two cooling loops according to the present invention.

FIG. 2 is a schematic view illustrating a configuration of an engine system having two cooling loops according to various embodiments of the present invention. Characteristic portions of FIG. 2, compared with FIG. 1, will be described, and descriptions of the same or similar portions will be omitted.

Referring to FIG. 2, the engine system 100 includes a first coolant loop 105 and a second coolant loop 110. A first coolant pump 155, a cylinder block 160, a cylinder head 165, an EGR cooler 170, an oil cooler 175, a turbo charger 180, a heater core 185, a thermostat 190, and a first radiator 150 are disposed in the first coolant loop 105. A second radiator 115, a second coolant pump 120, and a water-cooled intercooler 125 are disposed in the second coolant loop 110.

A first branch line 250 branches from one side of the first coolant loop 105, and a second branch line 255 branches from one side of the second coolant loop 110.

The first branch line 250 and the second branch line 255 join to form a single mixture line 260, and the mixture line 260 branches to a first return line 270 and a second return line 275. The first return line 270 joins the other side of the first coolant loop 105, and the second return line 275 joins the other side of the second coolant loop 110.

As illustrated, a temperature adjusting valve 200 is disposed in a point where the first branch line 250 and the second branch line 255 join, and the coolant distribution tank 210 is disposed in a point where the first return line 270 and the second return line 275 branch.

A temperature sensor 205 and an EGR cooler 170 are sequentially disposed between the temperature adjusting valve 200 and the coolant distribution tank 210 in the mixture line 260.

A first coolant to circulate through the first coolant loop 105 is supplied through the first branch line 250, and a second coolant to circulate through the second coolant loop 110 is supplied through the second branch line 255.

The temperature adjusting valve 200 may control a flow of the first coolant supplied through the first branch line 250 and a flow of the second coolant supplied through the second branch line 255, according to temperatures sensed by the temperature sensor 205 (temperature sensing device).

A mixture of the first and second coolants flows in the mixture line 260, and the mixture coolant passes through the temperature sensor 205 and the EGR cooler 170 to gather in the coolant distribution tank 210. The mixture coolant gathering in the coolant distribution tank 210 recirculates to the first coolant loop 105 and the second coolant loop 110 through the first return line 270 and the second return line 275.

In various embodiments of the present invention, the EGR cooler 170 may stably cool an exhaust gas recirculating from an exhaust line to an intake line. The reason is because the temperature adjusting valve 200 appropriately mixes the first coolant having a relatively high temperature and the second coolant having a relatively low temperature to stably maintain a temperature of the coolant passing through the EGR cooler 170.

The electronic control unit 280 controls a temperature of the mixture coolant by controlling the temperature adjusting valve 200 according to operation conditions of a vehicle and temperatures of the mixture coolant sensed by the temperature sensor 205.

The control unit 280 may be implemented as one or more microprocessors operated according to a preset program, and the preset program may include a series of commands for performing a method according to various embodiments of the present invention described hereinafter.

Figure 3:
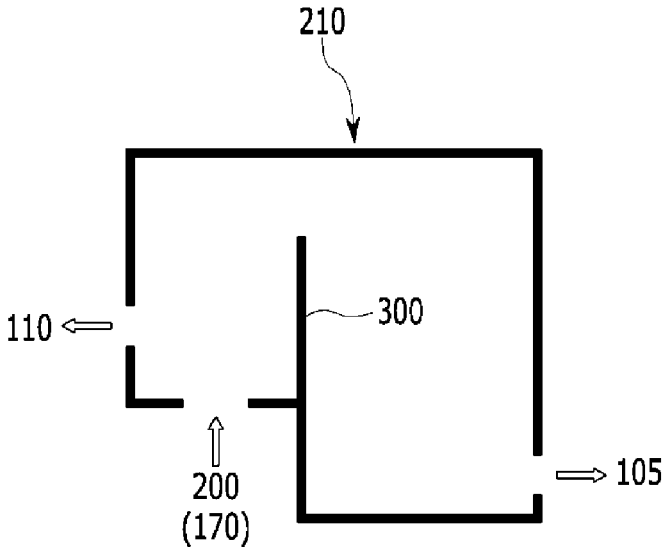
FIG. 3 is a schematic top plan view illustrating a cross-section of a coolant distribution tank in an exemplary engine system according to the present invention.

FIG. 3 is a schematic top plan view illustrating a cross-section of a coolant distribution tank in an engine system according to various embodiments of the present invention.

Referring to FIG. 3, the coolant distribution tank 210 includes an inlet 206 through which the mixture coolant from the temperature adjusting valve 200 is received, and two outlets 207 and 208 respectively connected to the first coolant loop 105 and the second coolant loop 110 on both sides thereof with respect to the inlet 206.

A partition 300 is formed within the coolant distribution tank 210. The partition 300 hinders a coolant supplied through the inlet 206 from being delivered to the outlet connected to the first coolant loop 105. That is, the partition 300 is formed to be adjacent to the inlet 206 and adjacent to the outlet 207 connected to the first coolant loop 105.

Figure 4:
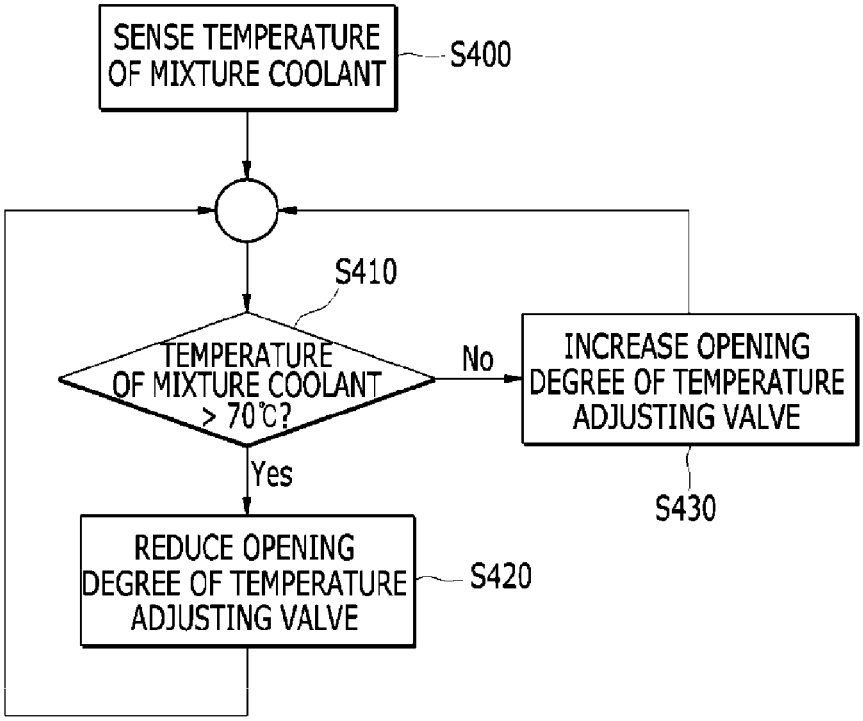
FIG. 4 is a flow chart illustrating a method for controlling an exemplary engine system having two cooling loops according to the present invention.

FIG. 4 is a flow chart illustrating a method for controlling an engine system having two cooling loops according to various embodiments of the present invention.

Referring to FIG. 4, a temperature of the mixture coolant is sensed by the temperature sensor 205 in step S400 and it is determined whether the sensed temperature of the mixture coolant is higher than a preset value (for example, 70° C.) in step S410.

When the sensed temperature is higher than the preset value, an opening degree of the temperature adjusting valve 200 is reduced to increase a supply amount of the second coolant circulating through the second coolant loop 110 and decrease a supply amount of the first coolant in step S420.

Conversely, when the sensed temperature is lower than the preset value, an opening degree of the temperature adjusting valve 200 is increased to increase a supply amount of the first coolant circulating through the first coolant loop 105 and decrease a supply amount of the second coolant in step S430.

In various embodiments of the present invention, the temperature adjusting valve 200 may be a 3-way valve, and an opening degree thereof may be varied continuously or in stages.

In various embodiments of the present invention, the first coolant having a relatively high temperature and the second coolant having a relatively low temperature are appropriately mixed to relatively stably maintain a temperature of the coolant passing through the EGR cooler.

Thus, the EGR cooler may stably cool an exhaust gas recirculating from the exhaust line to the intake line, and may be prevented from being damaged by a low temperature coolant.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine system having two cooling loops, the engine system comprising:

a first coolant loop in which a first coolant circulates through an engine and a first radiator forming a first closed loop;

a second coolant loop in which a second coolant circulates through a water-cooled intercooler and a second radiator forming a second closed loop without being overlapped with the first closed loop;

a first branch line that branches from one side of the first closed loop;

a second branch line that branches from one side of the second closed loop;

a first return line joining the first closed loop;

a second return line joining the second closed loop;

a mixture line allowing the first coolant flowing in the first branch line and the second coolant flowing in the second branch line to be mixed to flow a mixture coolant in the mixture line, the mixture line having first and second ends; and a temperature adjusting valve mounted at the first end of the mixture line, and configured to control flows of the first coolant flowing in the first branch line and second coolant flowing in the second branch line to control a temperature of the mixture coolant flowing in the mixture line;

wherein the first branch line and the second branch line joins the mixture line at the temperature adjusting valve, and the first return line and the second return line branch from the second end of the mixture line.

2. The engine system of claim 1, wherein the engine includes:

a first coolant pump disposed to pump the first coolant;

a cylinder block in which a piston is configured to be disposed in a cylinder;

a cylinder head disposed above the cylinder block;

a turbo charger disposed to compress intake air;

an oil cooler disposed to cool oil;

a heater core disposed to heat indoor air; and a thermostat disposed to control a flow path and a flow rate of a coolant.

3. The engine system of claim 1, wherein:

a second coolant pump pumping the second coolant is disposed in the second coolant loop.

4. The engine system of claim 1, wherein:

an exhaust gas recirculation (EGR) cooler cooling an exhaust gas recirculating from an exhaust line to an intake line by using the mixture coolant is disposed in the mixture coolant line.

5. The engine system of claim 4, wherein:

a coolant distribution tank is disposed on the mixture line downstream of the EGR cooler.

6. The engine system of claim 5, wherein:

the first return line and the second return line branch from the coolant distribution tank.

7. The engine system of claim 5, wherein:

an inlet through which the mixture coolant is supplied from the temperature adjusting valve is formed in the coolant distribution tank, first and second outlets respectively connected to the first coolant loop and the second coolant loop are formed on a first side and on a second side with respect to the inlet, and a partition hindering the mixture coolant from flowing from the inlet to the first outlet is formed in the coolant distribution tank.

8. The engine system of claim 1, further comprising:

a temperature sensing device configured to sense a temperature of the mixture coolant; and an electronic control unit (ECU) configured to control the temperature adjusting valve according to the temperature of the mixture coolant sensed by the temperature sensing device.

9. The engine system of claim 8, wherein:

the temperature adjusting valve comprises a 3-way valve and controls a flow of the first coolant flowing in the first branch line and a flow of the second coolant flowing in the second branch line.

10. The engine system of claim 1, wherein:

the first radiator outwardly dissipates heat of the first coolant circulating through the engine, the second radiator outwardly dissipates heat of the second coolant circulating through the water-cooled intercooler, and the water-cooled intercooler cools compressed air supplied to a combustion chamber of the engine.

* * * * *